United States Patent [19]

Walden

[11] 4,365,724

[45] Dec. 28, 1982

[54] ATTACHING CLOSURE TO CONTAINERS

[75] Inventor: Richard G. Walden, Childrey, Near Wantage, England

[73] Assignee: Metal Box Limited, Reading, England

[21] Appl. No.: 217,565

[22] Filed: Dec. 17, 1980

[30] Foreign Application Priority Data

Dec. 21, 1979 [GB] United Kingdom ..... 7944037

[51] Int. Cl.[3] ..... B65D 8/04

[52] U.S. Cl. ..... 220/67

[58] Field of Search ..... 220/66, 67

[56] References Cited

U.S. PATENT DOCUMENTS

| | | | |
|---|---|---|---|
| 2,382,378 | 8/1945 | Bloedorn | 220/67 X |
| 3,409,166 | 11/1968 | Croce et al. | 220/67 |
| 3,524,568 | 8/1970 | Nughes | 220/67 |
| 3,685,685 | 8/1972 | Phillips | 220/67 |
| 3,709,399 | 1/1973 | Nughes | 220/67 |
| 4,102,467 | 7/1978 | Woodley | 220/67 |
| 4,125,632 | 11/1978 | Vosti et al. | 220/66 X |

FOREIGN PATENT DOCUMENTS

| | | |
|---|---|---|
| 1374969 | 11/1974 | United Kingdom . |
| 1504695 | 3/1978 | United Kingdom . |

*Primary Examiner*—William Price
*Assistant Examiner*—Gary E. Elkins
*Attorney, Agent, or Firm*—Diller, Ramik & Wight

[57] ABSTRACT

A processable plastics pot has a seaming ring which is adapted to be double-seamed to the seaming ring of a conventional easy-opening metal closure to attach the closure to the container. The container seaming ring is designed so that the double-seaming operation can be satisfactorily, and reliably achieved over long production runs; various features of the seaming ring are described which are provided for this purpose.

1 Claim, 3 Drawing Figures

ATTACHING CLOSURE TO CONTAINERS

This invention relates to containers, in particular to plastics containers adapted for receiving seamed-on metal closures, especially those of the easy-opening variety. The invention has particular, but not exclusive, application to processable containers, that is to say, containers which are capable, when filled with product and closed, of undergoing thermal processing to sterilize the container and the contents within.

It has already been proposed to attach a metal closure to a plastics container by double-seaming the closure to the container by substantially the same method as has long been used for metal cans. However, because of the substantially reduced rigidity of plastics in comparison with metal, difficulties have been experienced in achieving satisfactory and reliable double seams. The difficulties are magnified in the case of processable food containers because of the stresses to which the containers may be subjected by the sterlization process, and the very high order of integrity needed to avoid microbiological spoilage.

Applicants were concerned to provide a plastics container which is capable of being double-seamed to a conventional end closure in a satisfactory and reliable manner over long production runs. We have found that this aim can be achieved by careful design of the seaming ring of the container, that is to say, the part of the container which is to form part of the double seam.

In accordance with the present invention from one aspect thereof there is provided, in combination, a plastics container and a metal end closure, the end closure having a seaming ring which comprises a frustoconical chuck wall and an arcuate seaming panel which extends from the chuck wall to a free edge provided by a peripheral curl, the plastics container having a base and, upstanding therefrom, an integral side wall having a seaming ring which defines the container mouth and is adapted for double-seamed engagement to the seaming ring of the end closure, the container seaming ring comprising a frustoconical seaming wall, a substantially radially directed flange providing a free peripheral edge to the container, and an arcuate wall portion joining the seaming wall and the flange, and being such that, when the closure is in position for seaming, the seaming rings of the container and closure are in substantially continuous mutual contact along the whole axial length of the container seaming ring, with the container seaming wall generally adjacent to, and in contact with, the chuck wall of the closure, and with the arcuate wall portion and flange of the container generally adjacent to, and in contact with, the seaming panel of the closure within the curl thereof.

In accordance with the invention from a second aspect there is provided, in combination, a plastics container having a base and an integral side wall upstanding therefrom and formed with a mouth, and a relatively rigid metal end closure closing said mouth, said closure comprising a central panel, and a seaming ring upstanding from the periphery of the central panel and comprising a frustoconical chuck wall and an arcuate seaming panel which extends from the chuck wall to a free edge provided by a peripheral curl, the container side wall having a seaming ring which defines the said mouth and is adapted for double-seamed engagement with the closure seaming ring, the container seaming ring comprising a frustoconical seaming wall, a substantially radially directed flange providing a free peripheral edge to the container, and an arcuate wall portion joining the seaming wall and the flange, the container and closure being in mutually related position for seaming in which position the seaming rings of the container and closure are in substantially continuous mutual contact along the whole axial length of the container seaming ring, with the container seaming wall generally adjacent to, and in contact with, the chuck wall of the closure, and with the arcuate wall portion and flange to the container generally adjacent to, and in contact with, the seaming panel of the closure within the curl thereof.

Preferably, the natural taper angle of the container seaming wall is at most equal to the upper angle of the closure chuck wall, the closure is an interference fit in the container over the whole length of the chuck wall, the closure is free to any contact with the container except for the said substantially continuous contact between the seaming rings, and over its axial length the arcuate wall portion of the container has a natural radius of curvature which is substantially equal to the radius of curvature of the seaming panel where the seaming rings are in contact.

The flange and seaming wall of the container may have a substantially constant thickness of material, the material thickness of the seaming wall being greater than that of the flange. With such an arrangement, and as particularly described, the arcuate wall portion of the container is defined between part-toric outer (concave) and inner (convex) surfaces of which the inner surface has a larger radius than the outer surface.

In order that the invention may be more fully understood a processable food container embodying the invention will now be described, by way of example, with reference to the accompanying drawings, in which.

Figure 1:
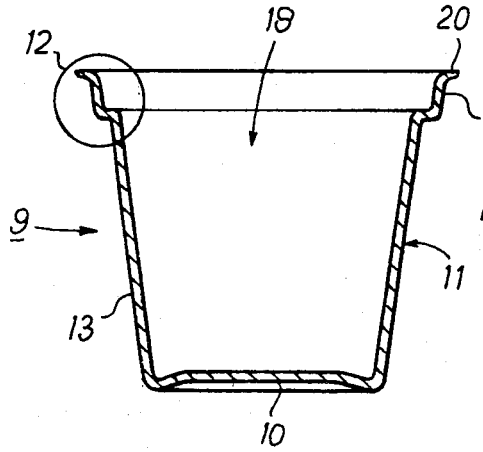
FIG. 1 shows the container before closure, in central vertical section.

Referring now to the drawings, a processable container 9 for a solid or semi-liquid food product is injection-moulded or thermoformed from a suitable plastics material such as polypropylene or high density polyethylene, preferably such as to give a low permeability to oxygen penetration. It has a circular, dished-in base 10 and a generally frustoconical side wall 11 which extends upwardly and in a divergent manner from the periphery of the base 10 to the container opening 18.

Figure 2:
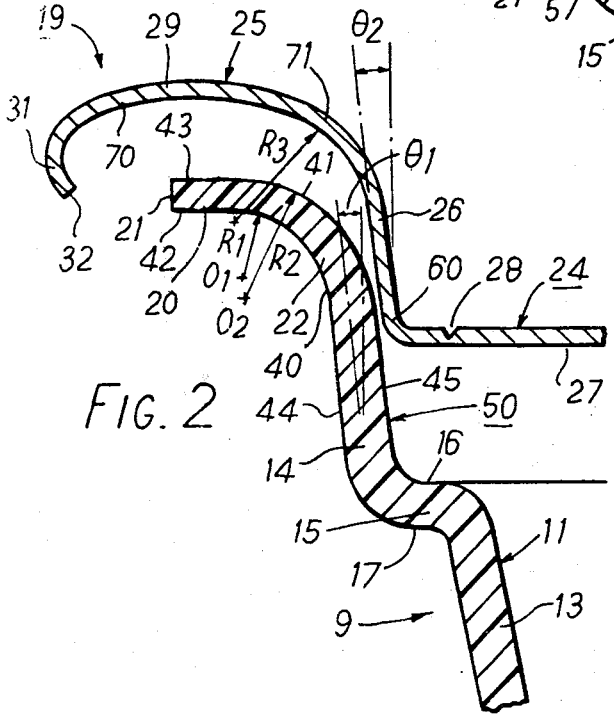
FIG. 2 is an enlarged view of the ringed portion of FIG. 1 immediately prior to the seaming operation to attach an easy-opening end closure to the container.

As can be seen from FIG. 1 and from FIG. 2 (which is an enlarged view of the ringed part 12 of FIG. 1), the side wall 11 includes a long frustoconical lower portion 13 and a short frustoconical upper portion 14. The two wall portions 13 and 14 each diverge in the direction away from the container base 10 (i.e. upwardly as shown); they are joined by a generally horizontal shoulder portion 15 which presents an upwardly facing annular surface 16 within the interior of the container, and a generally horizontal and downwardly facing annular surface 17 on the container exterior. As is later to become apparent, the wall portion 14 is the part of the side wall 11 which is to form part of the double seam; it is accordingly hereinafter referred to as the "seaming wall".

The free terminal edge 21 of the container is formed as an outturned, annular (i.e. horizontal as shown)

flange 20 which is joined to the seaming wall by an arcuate wall portion 22.

The seaming wall 14 has a uniform material thickness; likewise, the flange 20 has a uniform material thickness. This thickness of the flange is substantially less than the thickness of the seaming wall, the difference between the two thicknesses being accommodated at the arcuate portion 22 of which the thickness progressively reduces from the seaming wall to the flange. The radially outer, concave and inner, convex surfaces 40, 41 defining the arcuate portion lie on respective substantially toric envelopes of which the generatrix circles have centres $O_1$ and $O_2$ and radii $R_1$ and $R_2$ respectively. The lower and upper faces 42, 43 defining the flange 20 are tangential to the surfaces 40, 41, as are the radially outer and inner surfaces 44,45 defining the seaming wall 14.

The closure 19 (FIG. 2) to be applied to the container is a conventional end closure of the easy-opening variety stamped from aluminium or tinplate. It has a plane central panel 24, and a seaming ring 25 which surrounds the central panel and has a frustoconical chuck wall 26 by which it is integrally joined to the central panel at a circular heel 60. The chuck wall diverges in the direction away from the central panel, that is to say, upwardly as shown in FIG. 2.

The central panel 24 has a removable portion 27 (shown only in part) defined peripherally by a score line 28. In known manner the removable portion can be torn way along this score line by means of an attached pull tab (not shown) to enable the user to gain access to the container contents.

In addition to the chuck wall 26 the seaming ring 25 is formed of an arcuate seaming panel 29 which merges with, and is connected to, the chuck wall around its inner periphery. Around its outer margin the seaming panel is turned inwardly on itself to form a curl 31 with a cut free edge 32.

As will be seen from FIG. 2, the curl 31 is of small radius of curvature in relation to the remainder of the seaming panel 29. In addition to the curl the seaming panel is formed of a major central portion 70 of large radius of curvature, which extends generally radially of the closure and carries the curl 31 on its outside, and an inner marginal portion 71 of which the radius of curvature is intermediate those of the curl 31 and the central portion 70. It will be appreciated that there is no sudden transition between the control portion 70 and the curl 31, and between the central portion and the marginal portion 71; the radius of curvature in these regions varies to effect a smooth merging of the parts of the seaming panel on either side.

On the container the flange 20, the arcuate portion 22 and the seaming wall 14 together form a seaming ring which is adapted, in the manner to be described later in detail, to attach the closure reliably to the container in an hermetic and fluid-tight manner. This seaming ring is generally denoted in the drawings by the reference numeral 50.

Figure 3:
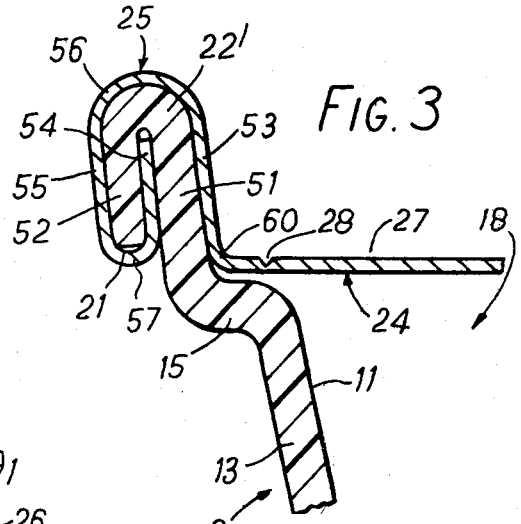
FIG. 3 is an enlarged view of the ringed portion of FIG. 1 after seaming.

FIG. 3 shows the completed double seam. From that figure it will be seen that, as seen in cross-section, the seaming ring 50 of the container is reformed so that it now has the form of an inverted U with substantially parallel inner and outer arms 51, 52. The seaming ring 25 of the closure has been reformed in close conformity with the seaming ring 50. Accordingly, it forms three substantially parallel, serially connected sections 53,54,55 of which the sections 53,55 form the inside and outside faces of the double seam, and the section 54 lies between the arms 51,52 so as to separate them from one another. The seaming ring 25 also forms major and minor bends 56, 57 which join the sections in pairs 53, 55 and 55, 54 at, respectively, the top and bottom ends of the double seam. In essence (but not precisely) the section 53 is formed from the chuck wall 26, the sections 54, 55 and the bends 56,57 being formed from the seaming panel 29.

The method used for effecting double-seaming may be conventional. In a preferred method the container with the closure loosely resting on top of it is lifted from below against a seaming chuck which engages face-to-face with the radially inner surface of the chuck wall 26 of the closure, and axial pressure is applied to the container/closure combination so as to force the closure axially of the container into its required position. With the closure held by the seaming chuck in this position, first and second seaming rolls are successively brought into engagement with the closure seaming ring 25 so as respectively, by applying radially inward pressure, to roll together and interlock the seaming panel 29 and the container flange 20, and compress the seam so formed to the required tightness.

During the formation of the double seam the seaming chuck reacts the radially inward forces generated on the closure by the seaming rolls, by engagement with the chuck wall 26 as described above. The support and location provided in this way for the closure is essential but is not in itself sufficient to ensure satisfactory seam formation. Applicants have found that the following relationships are desirable or essential to ensure achievement of this aim:

(1) The taper angle $\theta_1$ (FIG. 2) of the seaming wall 14 should be at most equal to, and preferably less than, the taper angle $\theta_2$ of the chuck wall 26. Typically $\theta_1$ lies within the range from just beyond 0° to 5° and $\theta_2$ within the range 5° to 9°. It is preferred that $\theta_2$ should exceed $\theta_1$ by an angle lying within the range 2° to 4°.

(2) The closure should be an interference fit in the container over the whole length of the chuck wall 26 from the heel 60 upwards. The negative clearance where the interference occurs should be subject to minimum and maximum values which are respectively 0.1% and 1.0% of the appropriate value of the container diameters.

(3) The closure should not engage the container shoulder 15. The nominal clearance provided between the under surface of the central panel 24 and the upper surface 16 of the shoulder should be at least sufficient to accommodate manufacturing tolerances so that the closure does not bottom on the shoulder. The shoulder plays little or no part in the seaming operation as such, and can be omitted in some applications. It is, however, desirable to act as a guard bead for the raw edge left on the container when the removable portion 27 of the closure 19 is torn away; to that end the inner periphery of the upper surface of the shoulder 15 is arranged to lie radially within the score line 28 as shown.

(4) The arcuate portion 22 of the container should have a radially inner radius $R_2$ which is substantially equal to the radially outer radius $R_3$ of the inner marginal portion 71 of the seaming panel 29.

(5) The seaming wall 14 should be of sufficient depth to ensure that, when the closure has been forced by the seaming chuck into its intended position in relation to the container in preparation for the operation of the seaming rolls, the heel 60 then being in the position shown in FIG. 3, the seaming rings 25, 50 of the closure and the container container engage one another over a contact interface which is continuous from the heel 60 on the closure to the free edge 21 on the container.

(6) The thickness of the seaming wall 14 should be greater than that of the flange 20. Desirably, the seaming wall thickness is from 0.65 mm to 0.75 mm, especially 0.70 mm, and the flange thickness is from 0.40 mm to 0.50 mm.

A processable container 9 which Applicants have found to form satisfactory and reliable double-seams with easy-opening end closures of the type designation E022B (marketed by Applicants) is thermoformed from polypropylene and has a seaming ring 50 with the following specification:

| | |
|---|---|
| Overall height | 5.6mm |
| Overall diameter (at free edge 21) | 71.5mm |
| Internal diameter (at shoulder 15) | 65mm |
| Radial width of flange (20) | 0.9mm |
| Material thickness at flange (20) | 0.5mm |
| Height of seaming wall (14) | 3.5mm |
| Taper angle ($\theta_1$) of seaming wall (14) | 5° |
| Material thickness at seaming wall (14) | 0.7mm |
| Outer radius ($R_1$) of arcuate portion (22) | 1.5mm |
| Inner radius ($R_2$) of arcuate portion (22) | 2.3mm |

With these dimensions the closure, when in position for seaming, makes an interference fit of 0.075 mm with the container at the elbow 60, and a spacing of 1.3 mm exists between the opposed surfaces 16, 27 at the shoulder 15.

The invention is not limited in application to processable food containers as particularly described, but may also be applied to containers for other products and to containers not required to undergo sterilisation. The container may be thermoformed or injection-moulded, from high density polyethylene, polypropylene or other suitable thermoplastics material. The end closure may be of tinplate or other suitable steel plate, or it may be of aluminium; it may be of the easy-opening variety, or otherwise.

What we claim is:

1. In combination, a plastics container and a metal end closure, the end closure having a seaming ring which comprises a frustoconical chuck wall, an arcuate seaming panel which extends radially outwardly from the chuck wall to a free edge provided by a peripheral curl and an end panel which is radially inboard of the chuck wall, the plastics container having a base and an upstanding integral side wall with a seaming ring defining a mouth of the container, the seaming ring being adapted for double-seaming engagement to the seaming ring of the end closure, the container seaming ring comprising a frustoconical seaming wall, a substantially radially outwardly directed flange providing a free peripheral edge to the container, an arcuate wall portion joining the seaming wall and the flange and an annular shoulder axially spaced from said flange and radially inboard of said seaming wall, the arrangement being such that, when the closure is in position for seaming, the seaming rings of the container and closure are in substantially continuous mutual contact along the whole axial length of the container seaming ring, with the container seaming wall generally adjacent to and in contact with the chuck wall of the closure and with the arcuate wall portion and flange of the container generally adjacent to and in contact with the seaming panel of the closure within the curl thereof but with the end panel and annular shoulder being in axially spaced relationship, the seaming wall and chuck wall defining a respective seaming wall angle and a chuck wall angle, the degrees of which are measured relative to the respective container axis and closure axis, said seaming wall angle lies within the range of up to 5°, said chuck wall angle lies within the range 5° to 9°, the difference between the seaming wall angle and the chuck wall angle of the container and end closure respectively lying within the range of 2° to 4°, the closure making an interference fit in the container over the whole length of the closure chuck wall, the negative clearance where the interference occurs lies within 0.1% and 1.0% of the appropriate value of the container diameters, said seaming wall and flange being of substantially constant material thickness, and in the seamed condition, the seaming rings of the container end closure remain in substantially continuous mutual contact along the whole axial length thereof while the end panel and annular shoulder remain in axially spaced relationship.

* * * * *